United States Patent [19]

Deutsch

[11] 4,300,432

[45] Nov. 17, 1981

[54] POLYPHONIC TONE SYNTHESIZER WITH LOUDNESS SPECTRAL VARIATION

[75] Inventor: Ralph Deutsch, Sherman Oaks, Calif.

[73] Assignee: Kawai Musical Instrument Mfg. Co., Ltd., Hamamatsu, Japan

[21] Appl. No.: 139,908

[22] Filed: Apr. 14, 1980

[51] Int. Cl.[3] ..... G10H 1/00

[52] U.S. Cl. ..... 84/1.01; 84/1.19; 84/1.27

[58] Field of Search ..... 84/1.01, 1.19, 1.22, 84/1.24, 1.27

[56] References Cited

U.S. PATENT DOCUMENTS 3,908,504 9/1975 Deutsch ..... 84/1.27
4,122,742 10/1978 Deutsch ..... 84/1.19
4,175,464 11/1979 Deutsch ..... 84/1.19
4,214,503 7/1980 Deutsch ..... 84/1.27

*Primary Examiner*—J. V. Truhe
*Assistant Examiner*—Forester W. Isen
*Attorney, Agent, or Firm*—Ralph Deutsch

[57] ABSTRACT

In a musical instrument having one or more tone generators in which a plurality of data words corresponding to the amplitudes of a corresponding number of evenly spaced points defining the waveform of one cycle of an audio signal are transferred sequentially from a note register to a digital-to-analog converter in repetitive cycles at a rate proportional to the pitch of the tone being generated, apparatus is provided for varying the spectral content of the tones in response to a loudness control signal. Loud tones are produced with a greater number of harmonics than those for a soft tone.

11 Claims, 7 Drawing Figures

POLYPHONIC TONE SYNTHESIZER WITH LOUDNESS SPECTRAL VARIATION

BACKGROUND OF THE INVENTION

1. Field of the Invention

This invention relates broadly in the field of electronic musical tone generators and in particular is concerned with provision for causing a loudness signal to control the spectral content of the generated tones.

2. Description of the Prior Art

An elusive goal in the design of electronic musical instruments is the ability to realistically imitate the sounds of conventional acoustic type orchestral musical instruments. The best results have been obtained for electronic musical instruments which imitate wind-blown pipe organs and harpsichords. The principal reason for obtaining good imitative results for these instruments is that they are essentially mechanical tone generators. The tone generation is automatic and the musician only actuates on-off switches. With the notable exception of these two instruments, the tone character of almost all other musical instruments is a function of certain skills possessed by the musician.

It has long been recognized that with the notable exception of conventional organ tones, almost all tones from musical instruments exhibit tone spectra which are time variant. The recognition of the characteristic time variant spectra has motivated the development of electronic musical generating systems such as those known by the generic names of "sliding formant" and "FM-synthesizer." Sliding formanttone generators constitute a class of generators which are also called subtractive synthesis. In subtractive synthesis, the fundamental tone source generates more than the desired tone spectral components and the undesired spectral components are attenuated, or filtered out, by means of some variety of frequency filter. The FM-synthesizer is of the additive variety in that FM (frequency modulation) is used to add components to a source signal which frequently consists of a simple single frequency sinusoid time function.

The imitation of acoustic orchestral musical instruments using synthesis techniques such as the sliding formant or FM-synthesizer has been of the trial and error variety. One adjusts a multiplicity of tone controls and ADSR envelope controls until an output tone is produced which is judged to be "near to" or imitative of some particular musical instrument. These techniques are definitely not of the more academic procedure in which one first analyzes the tones from a selected musical instrument, then constructs an analytical model of the tone generator, and finally uses the experimentally obtained parameters in the analytical model to synthesize tones that closely imitate the original.

The academic approach of analysis, modeling, and synthesis for musical instrument sounds is obviously not an easily implemented technique judging from the current lack of success except in a few relatively isolated instances. Part of the problem rests in the inability to adequately model many of the subtleties in tone structure imparted by the musician in an effective performance on his instrument. The musician commonly uses a technique such that the tonal structure for a given musical note varies with the loudness of the tone. Repeated notes are played with different loudness and tonal structure and this subtle difference removes the mechanical-like repeated tones produced by most electronic musical tone generators. Even very expert players are unable to repeat a given tone with precisely an identical tone spectra. In general, as the tone level becomes louder, the tone spectra increases in the number and strength of the higher harmonics. Very soft tones tend to approach tones having only a few harmonics.

Many of the problems encountered in the synthesis of realistic imitations of orchestral instruments are similar to those encountered in the implementation of speech synthesizers which attempt to imitate human speech. In a common variety of a speech synthesizer a pulse-like repetitive waveshape is used as one of the basic sound sources. This source is modified by linear and nonlinear system transformations in response to time variant system control parameters such that the net result is imitative of human speech.

An application of nonlinear system transformations in the generation of musical sounds is contained in the technical article:

Beauchamp, J., "Brass Tone Synthesis by Spectrum Evolution Matching with Nonlinear Functions." *Computer Music Journal,* Vol. 3, No. 2, pp 35–42 (1979).

SUMMARY OF THE INVENTION

In a Polyphonic Tone Synthesizer of the type described in U.S. Pat. No. 4,085,644 a computation cycle and a data transfer cycle are repetitively and independently implemented to provide data which are converted to musical waveshapes. The tone generator can be operated in either of two modes which are selected by the action of mode switches. In the first mode, corresponding to the operation described in the referenced patent, a computation cycle is implemented during which a master data set is created by implementing a discrete Fourier algorithm using a stored set of harmonic coefficients which characterize a preselected musical tone. The computations are carried out at a fast rate which may be nonsynchronous with any musical frequency. Preferably the harmonic coefficients and the orthogonal functions required by the Fourier algorithm are stored in digital form and the computations are carried out digitally. At the end of a computation cycle, the master data set is stored in a main register.

Following a computation cycle for the system in the first mode, a transfer cycle is initiated during which the master data set is transferred to preselected members of a multiplicity of note registers. Tone generation continues uninterrupted during the computation and the transfer cycles.

The present invention is directed to an improved arrangement for generating the master data set. By the present invention a second mode is implemented for computing a master data set having a spectral content which is variable in response to an input spectral control signal. In the second mode, a sinusoid function is used to address data values from a transform memory which contains a preselected set of data points. The sinusoid function is scaled in magnitude by the input spectral control signal thereby causing a variable subset of the transform memory contents to be read out and stored in the main register.

Following a computation cycle for the system in the second mode, a transfer cycle is initiated in which the master data set is first adjusted to have a zero average value and then transferred to the preselected members of a multiplicity of note registers.

An application of the present invention is to cause the tone generator to produce tones having spectral components which can be made to be time variant in response to a control signal such as the note ADSR (attack-/decay/sustain/release) envelope function. The tone color (spectral content) can also be made to vary in response to the musical instrument's loudness control.

BRIEF DESCRIPTION OF THE DRAWINGS

The detailed description of the invention is made with reference to the accompanying drawings wherein like numerals designate like components in the figures.

DETAILED DESCRIPTION OF THE INVENTION

Figure 1:
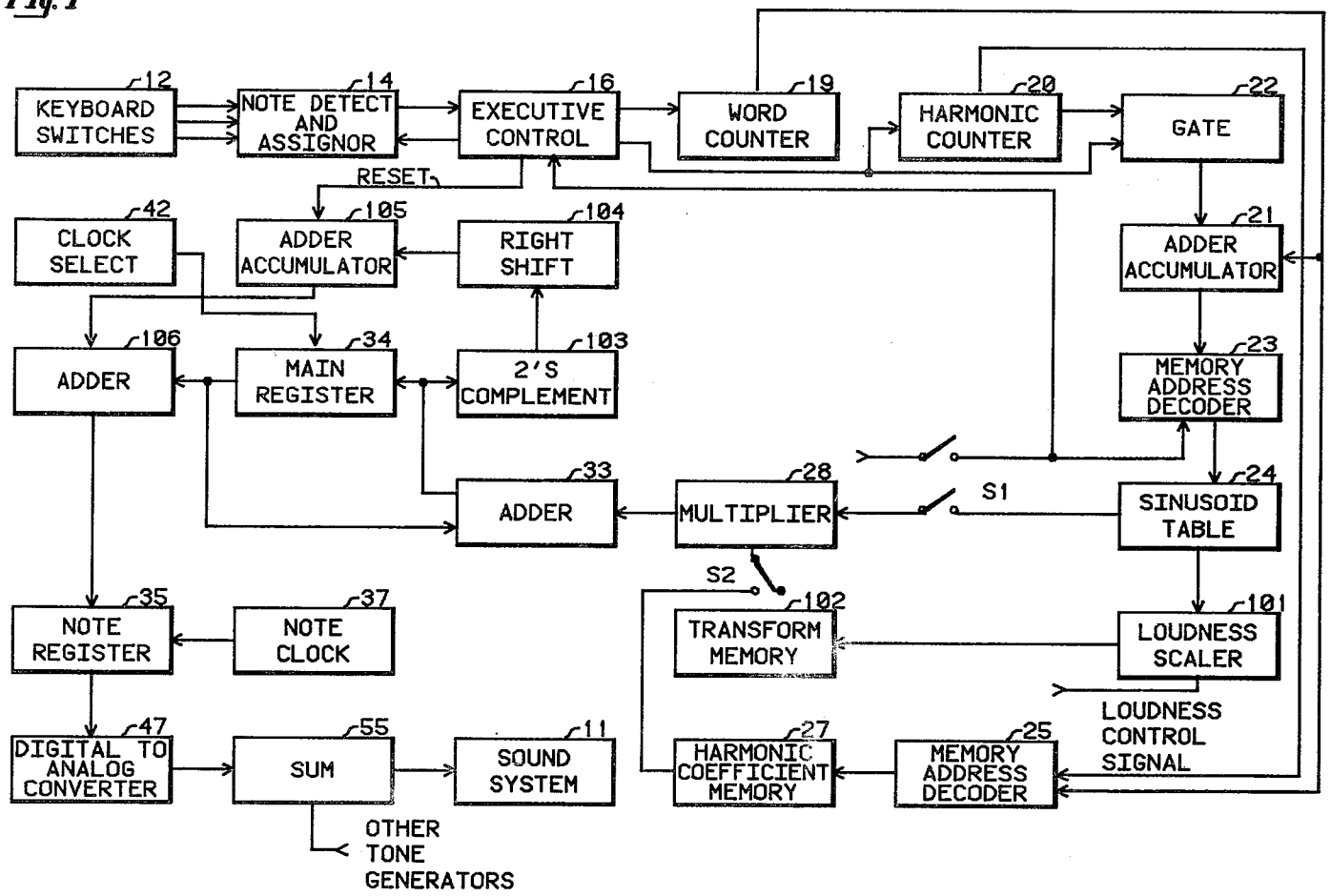
FIG. 1 is a schematic block diagram of an embodiment of the invention.

FIG. 1 shows an embodiment of the present invention which is shown and described as a modification to the system described in detail in U.S. Pat. No. 4,085,644 entitled "Polyphonic Tone Synthesizer" which is hereby incorporated by reference. All two-digit reference numbers used in the drawings correspond to the similarly numbered elements in the disclosure of the above-identified patent.

As described in the patent, the Polyphonic Tone Synthesizer includes an instrument keyboard 12 which, for example, corresponds to the conventional keyboard of an electronic musical instrument such as an electronic organ. By depressing one or more keys on the instrument keyboard, a note detect and assignor circuit 14 stores the note information for the keys that have been actuated and assigns each actuated note to one of twelve separate tone generators. A note detect and assignor circuit is described in U.S. Pat. No. 4,022,098 which is hereby incorporated by reference. When one or more keys have been depressed, an executive control circuit 16 initiates a computation cycle during which a master data set consisting of 64 words is computed and stored in a main register 34. The 64 words are generated with values which correspond to the amplitudes of 64 equally spaced points for one cycle of the audio waveform of the tone to be generated by the tone generators. The general rule is that the number of harmonics in the tone spectra is no more than one half of the number of data points in one complete cycle.

Two modes of operation are incorporated in the system shown in FIG. 1. The first mode corresponds to the operation described in U.S. Pat. No. 4,085,644. The first mode is entered by closing switch S1 and by operating switch S2 to select the output from the harmonic coefficient memory 27. In the first mode, the manner in which the Polyphonic Tone Synthesizer generates the waveform defining master data is the same as that described in detail in the above referenced patent.

As data furnished at the output of adder 33 is sent to be stored in the main register 34 it is also converted to a binary 2's complement form by means of the 2's complement 103. The output data from the 2's complement 103 is divided by 64 by means of the right shift 104 which performs a right shift of 6 binary bit positions on the input data. The output data from right shift 104 is added successively to the contents of the accumulator contained in the adder-accumulator 105. The accumulator is initialized at the start of a computation cycle under command of a RESET signal furnished by the executive control 16. The net result is that at the end of a computation cycle, the accumulator contains a value equal to the negative of the average value of the data values contained in the master data set stored in the main register 34.

At the completion of a computation cycle, the executive control 16 initiates a transfer cycle during which the master data set stored in the main register 34 is read out to the adder 106, and added with the contents of the accumulator in the adder-accumulator 105. The summed data is transferred to a note register 35 in one of the assigned tone generators. The net result is that the transferred data will constitute a translated master data set and have a zero average value.

A tone generator comprises a note register, note clock, and a digital-to-analog converter. The note generators are supplied values of the translated master data set at the end of each computation cycle of a sequence of computation cycles.

The note register 35 stores the transferred 64 data words which correspond to one complete cycle of the musical tone to be generated. These data points are read out of the note register 35 repetitively and sequentially and transferred to a digital-to-analog converter 47 which converts the input digital data into an analog voltage of the desired musical waveshape. The analog voltages from other tone generators are combined in sum 55 and the combined signal is applied to a sound system 11 to be converted into audible sounds.

The data points are transferred out of the note register 35 at a clock rate generated by an associated note clock 37. There is such a note clock in each of the tone generators. The note clock can be implemented as a voltage controlled oscillator whose frequency is set at 64 times the fundamental musical frequency of the associated keyed note on the keyboard. Thus all 64 waveshape data points are transferred to the digital-to-analog converter 47 in a time interval corresponding to one period of the pitch, or fundamental frequency, of the selected note.

There are a variety of methods for implementing the voltage controlled oscillator used for the note clock 37. One such method is described in detail in U.S. Pat. No. 4,067,254 entitled "Frequency Number Controlled Clocks" which is hereby incorporated by reference.

As further described in the above-identified U.S. Pat. No. 4,085,644, it is desirable to be able to continuously recompute the master data set which resides in the main register 34 during a sequence of computation cycles and to reload this data in the note register 35 while the associated key on the keyboard remains depressed. This is accomplished without interrupting the flow of data points to the digital-to-analog converter at the note clock rate.

While the circuitry for only one tone generator is shown explicitly in FIG. 1, it will be understood that twelve such tone generators including twelve associated note clocks are normally provided in the preferred embodiment of the Polyphonic Tone Synthesizer.

In FIG. 1, word counter 19 counts the timing pulses modulo 64 as furnished by the system master clock. The harmonic counter 20 counts modulo 32 which is the maximum number of harmonics consistent with a master data set having a total of 64 data points. The harmonic counter 20 is incremented each time that the word counter 19 is returned to its initial state. As described in detail in the above referenced U.S. Pat. No. 4,085,644, the count state of the harmonic counter 20 is transmitted via gate 22 to the adder accumulator 21. The memory address decoder 23 reads values of the stored sinusoid table from sinusoid table 24 in response to the contents of adder-accumulator 21.

During a computation cycle for the first operation mode, executive control 16 causes the word counter 19 to be incremented by 32 full counting cycles of 64 counts per cycle.

A set of harmonic coefficients $c_q$, corresponding to the desired spectral content of a musical tone, are stored in the harmonic coefficient memory 27. The harmonic coefficients are addressed out of the harmonic coefficient memory 27 by the memory address decoder 25 in response to the state of the harmonic counter 20. The addressed harmonic coefficients are multiplied by the addressed sinusoid values in the multiplier 28 in the manner described in the above referenced U.S. Pat. No. 4,085,644.

The second operation mode of the system shown in FIG. 1 is selected by opening switch S1 and operating switch S2 to select the output from the transform memory 102. In the second operation mode, the computation cycle is limited to 64 clock times during which the word counter 19 is incremented for 64 count states while the harmonic counter 20 remains at its initial unit count state.

The sinusoid function values accessed from the sinusoid table 24 are scaled in magnitude by the loudness scaler 101 and the scaled values are used to address stored data from the transform memory 102. The loudness scaler 101 is a data value multiplier in which the multiplier is varied by means of a Loudness Control Signal. This signal can be obtained from a variety of sources depending upon the desired musical effect. Such sources include touch responsive keyboard switches, pressure sensitive keyswitches in which the signal output of the pressure sensor varies with the pressure exerted on a closed keyswitch, the signal output from an ADSR envelope generator, and loudness compensation data.

A method of obtaining a loudness control signal is described in the patent application Ser. No. 019,318 entitled "Electronic Musical Instrument With Automatic Loudness Compensation" and filed Mar. 9, 1979, now U.S. Pat. No. 4,214,503. This application has a common assignee with the present invention.

For added realism, a random signal can be added to the loudness control signal so that repeated notes will always differ in spectral content from each other.

The transform memory 102 consists of an addressable memory storing 64 nonlinear data points computed in a manner described below. The transform memory 102 also contains an internal memory address decoder for accessing stored data in response to the signals transferred by the loudness scaler 101. These signals are rounded off to the closest integer value corresponding to the 64 memory addresses for the stored nonlinear data points.

When switch S1 is in its open state, multiplier 28 is caused to operate with a unit multiplier. Thus in the second operation mode, the multiplier transfers input data from the transform memory unaltered to the adder 33.

The remainder of the system functions following the multiplier 28 are identical for both the first and second operation modes.

As described above, the combination of the 2's complement 103, right shift 104, adder-accumulator 105 and adder 106 is employed to cause the data set transferred to a note register to have a zero average value. A zero average value is desirable so that keying clicks do not occur at the start and release of a generated musical tone. A zero average value is desirable when a combination of tone generators are summed to prevent overload saturation of either analog or digital devices that may operate upon the summed combination signal.

The use of the zero average value circuitry is not required for the conventional operation of the Polyphonic Synthesizer which corresponds to the first operation mode. In this case a zero average value is automatically obtained for the master data set by the manner in which it is computed. However, as described below, such a zero average value condition for the master data set does not automatically result when the second operation mode is used.

The nonlinear data stored in the transform memory 102 is used essentially to perform a nonlinear amplitude transformation on the sinusoid function data values addressed out from the sinusoid table 24 and scaled in magnitude by the loudness scaler 101. It is well-known in the signal theory art that if a signal is transformed by a nonlinear transformation then the result is an output signal that contains more frequency components than existed in the original signal. Discussions of nonlinear transformations can be found in the book: Deutsch, Ralph, *Nonlinear Transformation of Random Processes.* Prentice-Hall, Inc., 1962.

It is a property of the system shown in FIG. 1 that the maximum number of harmonics contained in a master data set cannot be greater than 32, or one-half of the number of equally spaced data points comprising one cycle of the generated musical tone. Thus, even with the nonlinear amplitude transformation, the total number of harmonics is limited and this characteristic of the present invention eliminates any requirement for any other means to limit or modify the spectral content following the nonlinear amplitude transformation.

As suggested by Beauchamp in the above referenced technical article, the nonlinear transformation data set can be calculated from an n'th degree polynomial having the form $$F(j) = \sum_{n=0}^{N} a_n x^n(j) \qquad \text{Eq. 1}$$

where j is an integer in the range of 1 to 64, and N is the total number of harmonics with the relation that N is no greater than 64/2. x is the input signal having the single frequency sinusoid form $$x(j) = A_0 \cos(\pi j/32) \qquad \text{Eq. 2}$$

$A_0$ is an arbitrary amplitude constant. Eq. 2 and Eq. 1 can be combined to obtain a finite series of the form $$F(j) = \sum_{n=0}^{N} P_n c_n \cos(\pi n j/32) \qquad \text{Eq. 3}$$

The $c_n$ are the harmonic coefficients contained in a signal defined by the set of nonlinear transformation data points F(j). The $P_n$ are phase constants.

A relation between the nonlinear coefficients $a_n$ and the set of harmonic coefficients $c_n$ can be obtained by using the following trigonometric expansion for the cosine of a multiple angle $$\cos n\theta = 2^{n-1}\cos^n\theta - \frac{n}{1!}2^{n-3}\cos^{n-2}\theta + \frac{n(n-3)}{2!}2^{n-5}\cos^{n-4}\theta - \frac{n(n-4)(n-5)}{3!}2^{n-1}\cos^{n-6}\theta + \ldots, n > 2. \qquad \text{Eq. 4}$$

This series terminates when a coefficient is equal to zero. If Eq. 4 is substituted in Eq. 3 and the elements are compared termwise with those for the same trigonometric multiple angle in Eq. 1, the desired relation between the coefficients is found to be $$a_j = \tfrac{1}{2}(2/A_0)^j \sum_{k=0}^{[(n-j)/2]} (-1)^k \cdot (j+2k)(j+k-1)!P_{k+2j}c_{k+2j}/k!j! \qquad \text{Eq. 5}$$

The nonlinear transformation data is computed by first calculating the set of nonlinear coefficients $a_j$ from Eq. 5 starting with a preselected set of harmonic coefficients $c_j$. The values of $c_j$ are chosen to obtain a desired musical tone corresponding to the maximum value of the loudness control signal furnished to the loudness scaler 101. Using these values of $a_j$, the nonlinear transformation data is calculated from Eq. 1. In Eq. 5 it is convenient to use the constant value $A_0=2$. The phase numbers $P_n$, also called the phase constants, all have the values +1 or −1. These numbers are selected as described in the previously referenced U.S. Pat. No. 4,085,644. Selecting the values of $P_n$ as described in the referenced patent will result in a maximum RMS value for the nonlinear transformation data set F(j) for a given prescribed peak signal value limitation imposed by the number of binary bits in a digital word used to represent the data values.

The following set of values for $P_n$ are listed in the referenced patent and have been experimentally verified to produce satisfactory results:

| |
|---|
| −1,−1,−1,−1,−1,−1,−1,−1,1,1,1,−1,−1,−1,1,1 |
| −1,−1,1,1,−1,1,1,−1,1,−1,−1,1,−1,1,−1,1 |
| −1,−1,−1,−1,−1,−1,−1,−1,−1,1,1,1,−1,−1,−1,1,1 |
| −1,−1,1,1,−1,1,1,−1,1,−1,−1,1,−1,1,−1,1 |

The following alternative set of phase numbers $P_n$ have also been verified to produce satisfactory results:

| |
|---|
| 1,−1,1,1,1,−1,−1,1,1,−1,1,1,1,1,1,1 |
| 1,1,−1,−1,1,−1,1,−1,−1,−1,1,1,−1,1,−1,−1 |
| 1,−1,1,1,1,−1,−1,1,1,−1,1,1,1,1,1,1 |
| 1,1,−1,−1,1,−1,1,−1,−1,−1,1,1,−1,1,−1,−1 |

The particular form of x(j) given by Eq. 2 assumes that the sinusoid table 24 stores values of the cosine trigonometric function. If desired this table can also be used to store the trigonometric sine values. If the sine values are stored, opening switch S1 will cause a fixed constant to be added to the input to memory address decoder 23. This fixed constant is used to advance the phase of the addressed sine values by 90 degrees to produce the cosine value for the same addressed value of the argument.

Figure 2:
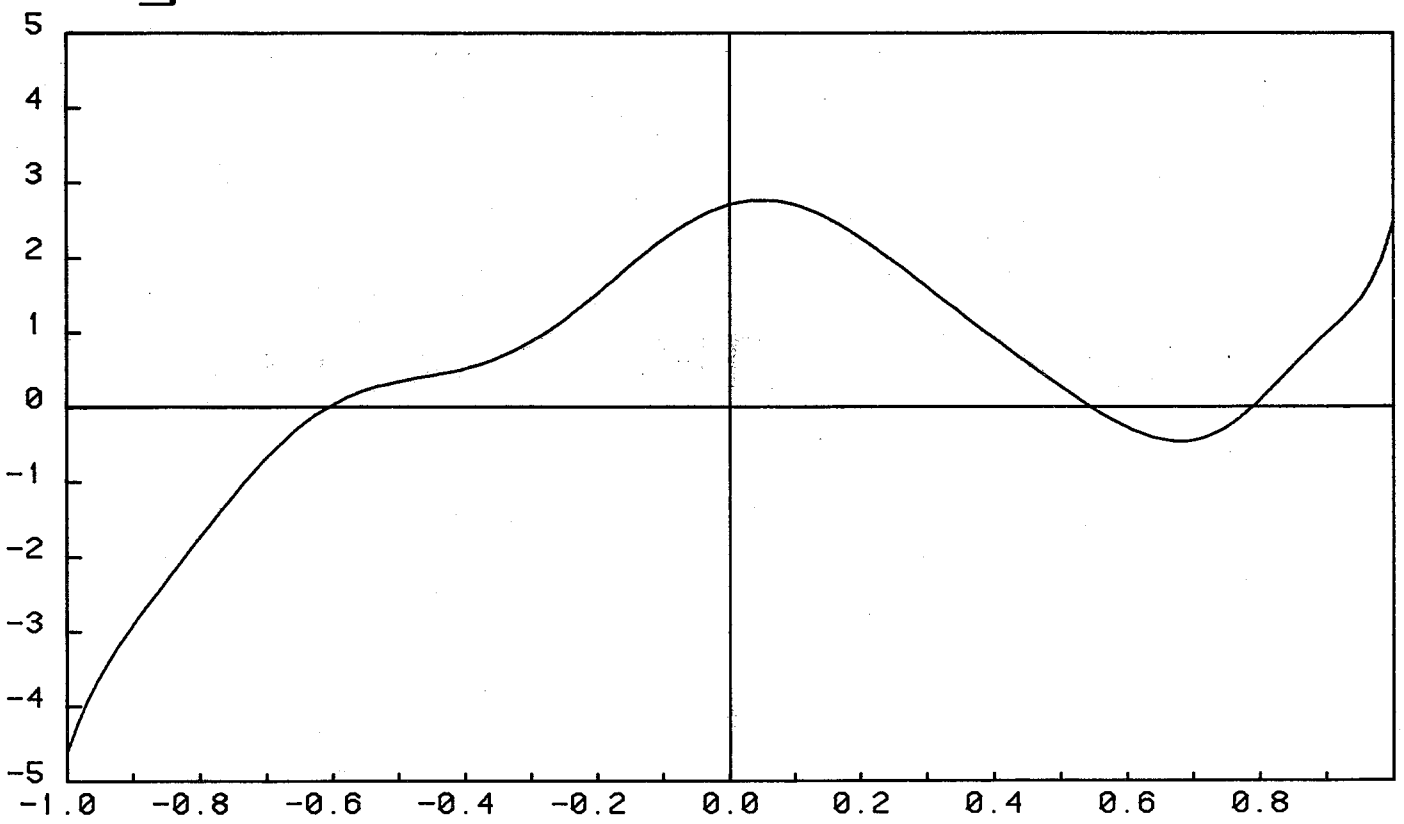
FIG. 2 is a graph of a nonlinear transformation.

FIG. 2 shows a plot of the nonlinear transformation data set F(j) for a musical tone having the spectral components listed in Table 1.

TABLE 1

| Harmonic | db | Nonlinear coefficient $a_j$ |
|---|---|---|
| 0 | −99 | 1.207 |
| 1 | 0 | 0.541 |
| 2 | 2 | −2.782 |
| 3 | 5 | −0.897 |
| 4 | 10 | 3.489 |
| 5 | 13 | 0.396 |
| 6 | 19 | −2.643 |
| 7 | 20 | −0.129 |
| 8 | 25 | 1.056 |
| 9 | 28 | 0.101 |
| 10 | 28 | −0.208 |
| 11 | 29 | −0.036 |
| 12 | 29 | 0.015 |
| 13 | 41 | 0.003 |
| 14 | −99 | 0 |
| 15 | −99 | 0 |
| 16 | −99 | 0 |

The x-axis values are the input data to the transform memory 102 from the sinusoid table. These values are shown for the decimal magnitudes +1 to −1 corresponding to the normalized range of values for the trigonometric cosine function.

The use of the phase constants $P_n$ produces another improvement not taught in the prior art of creating new frequencies by the use of nonlinear transformation of signals. As the cosine values are reduced by the loudness scaler 101, only a limited range of the data contained in the transform memory 102 is addressed out. Thus the RMS value of the master data set will vary with the loudness control signal variations. This action takes place in the proper musical direction in that softer tones will have fewer harmonics. It has been found that if all the $P_n$ have the same value, then for loudness scaler ranges of 20 db, the power level associated with the master data set can vary by about 40 db. If the $P_n$ have the values shown in the second set listed above, then the power level will only vary by about 20 db which is a significant improvement in permitting a large dynamic range in the loudness control signal without producing an intolerable decrease in the loudness of the tones generated from the master data set.

Figure 3:
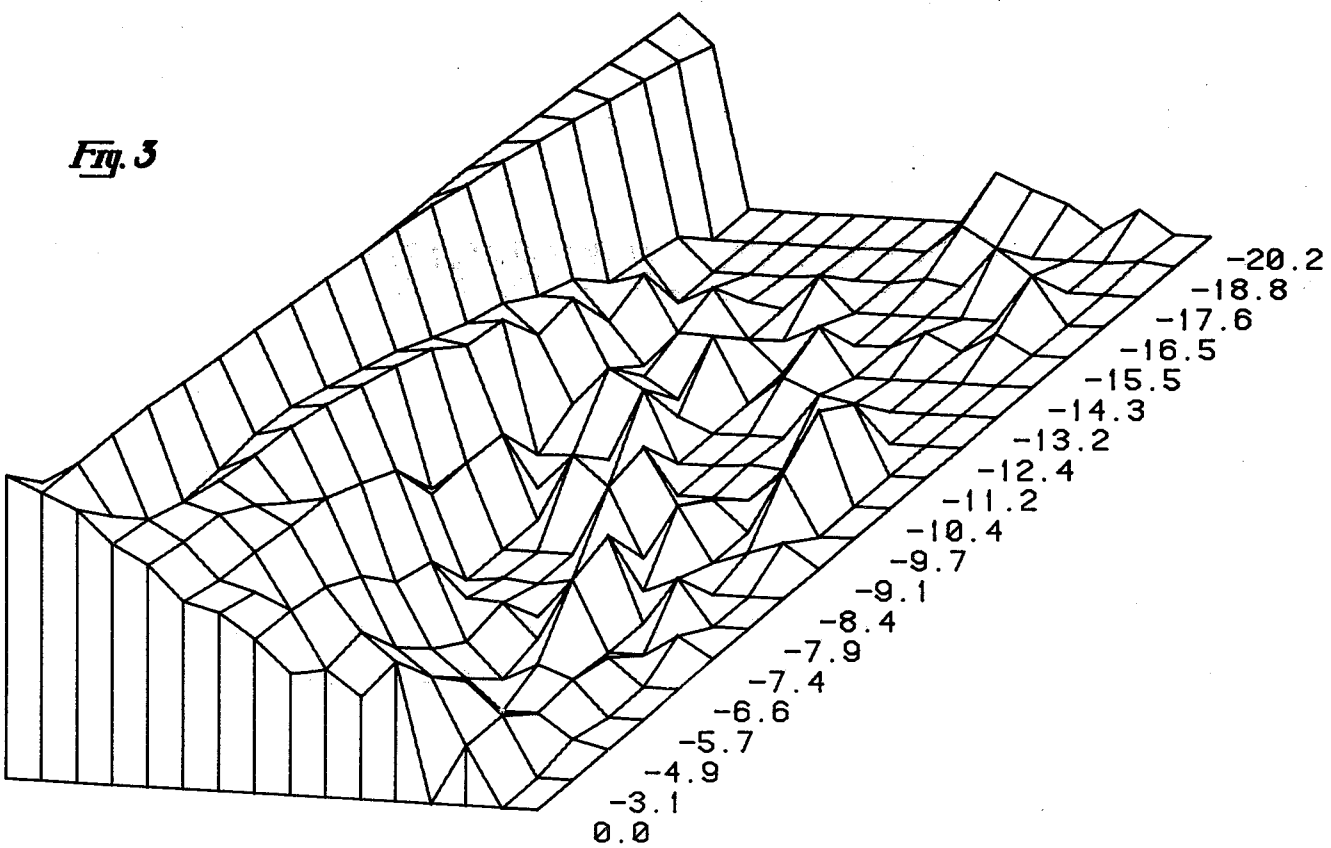
FIG. 3 is a three dimensional graph of the spectral variation produced in the output signal.

FIG. 3 is a three-dimensional plot of the output signal to the sound system of FIG. 1 using the data shown in FIG. 2 stored in the transform memory 102. The number on the right-hand end of each spectra indicates the number of db attenuation of the cosine values made by the loudness scaler 101.

Because the cosine function is even symmetric at the value of the argument $\theta=\pi$, the system shown in FIG. 1 can be operated in the even symmetric manner described in detail in the referenced U.S. Pat. No. 4,085,644. Thus only 32 points are required for the master data set. When this mode of operation is used, word counter 19 is made to count modulo 32 during the computation cycle. The right shift 104 performs a right shift of 5 binary bit positions corresponding to a division by the value 32. During the transfer cycle data is addressed out of the main register 34 in a forward and reverse order as described in the referenced patent so that the complete data set of 64 points for a waveshape cycle is transferred to the note register 35.

Figure 4:
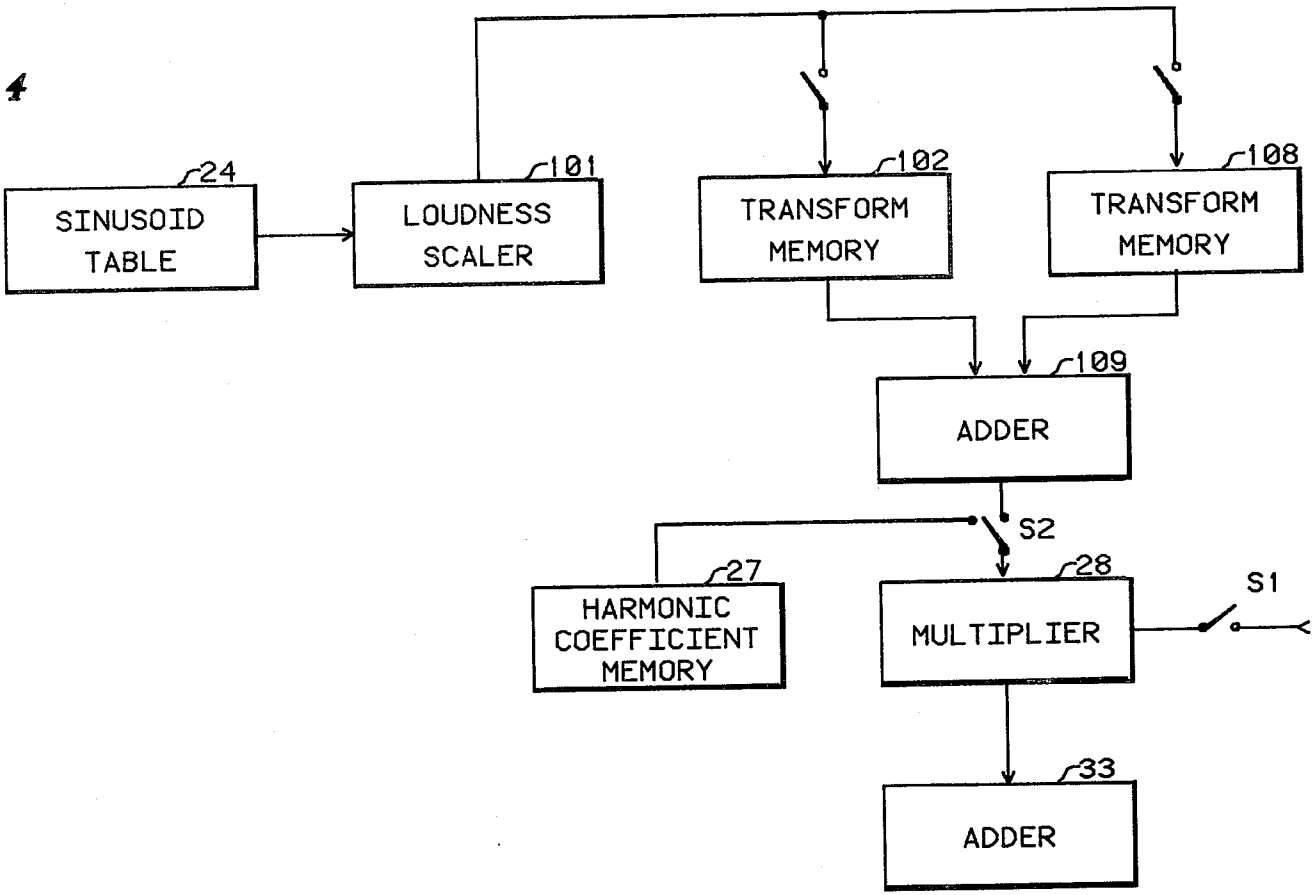
FIG. 4 is a schematic block diagram of a system with a sum of additive variable tone sources.

FIG. 4 shows a modification of the system shown in FIG. 1. The modification permits the use of a multiplicity of additive tones comprising the master data set in which each of the individual constituent tones can have its own independent spectral variations. The number of transform memories shown symbolically by transform memories 102 and 108 is equal to the number of desired multiplicity of additive tones.

In the second mode of operation, the computation cycle proceeds in the manner previously described. The desired tone combination is obtained by actuating selected sets of the switches associated with the input terminals of the set of transform memories. The output data addressed out of the set of transform memories is summed in adder 109 and the summed output is transferred to the multiplier 28. The remainder of the system is the same as that shown in FIG. 1 and previously described.

In the system shown in FIG. 4, the multiplicity of additive tones are varied in spectral content by means of a common loudness scale factor introduced by the loudness scaler 101. In the alternative embodiment shown in FIG. 5, each of the combined tones is varied in spectral content under control of its own independent loudness scaler. Thus a loudness scaler, shown symbolically as loudness scaler 101 and 109, is associated with each of a multiplicity of transform memories. The desired combination of tones is controlled by actuating the switches controlling the input signals to each of the loudness scalers.

Figure 5:
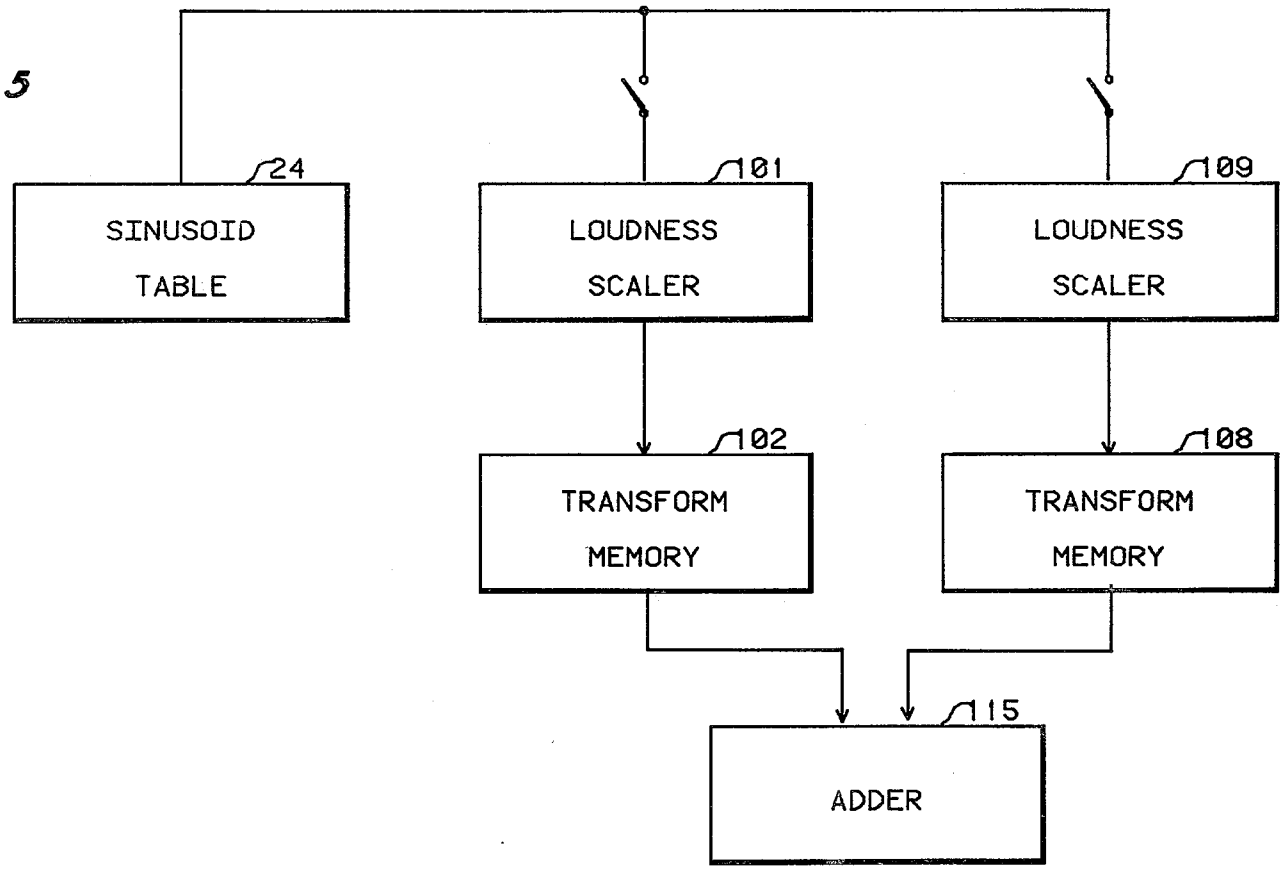
FIG. 5 is a schematic block diagram of a system having individual tone variation controls.

The use of a system such as that shown in FIG. 5, introduces a wide flexibility in the possible musical tone effects. For example, one of the constituent tones as determined by a transform memory can be varied in response to a touch response keyboard switch sensor while a second tone can be varied in response to the pressure exerted on the same actuated key after it is closed. Another possibility is to cause one of the constituent tones to be varied in response to the ADSR envelope function. These loudness control signals are each introduced as an input to one or more of the loudness scalers.

Because of the system characteristic previously pointed out in that the number of harmonics in the data set is automatically limited to be no more in number than one-half of the number of data words comprising a complete waveshape cycle it is not an inherent limitation of the system shown in FIG. 1 that the transform memory 102 be addressed by a sinusoid function.

Figure 6:
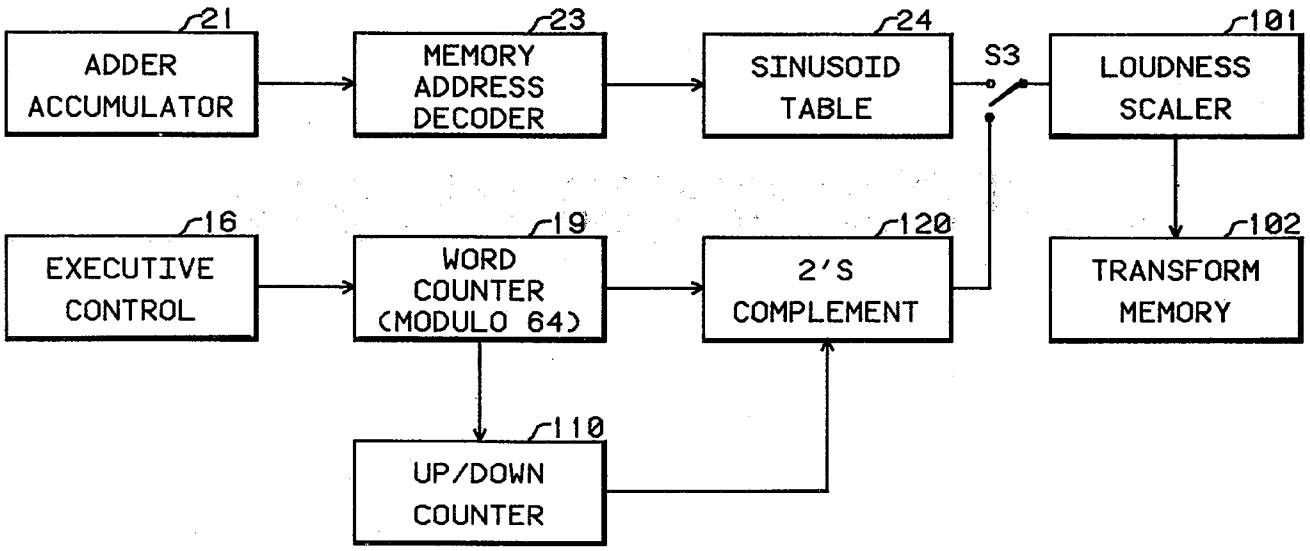
FIG. 6 is a schematic block diagram of an alternative embodiment of the invention.

FIG. 6 illustrates an alternative embodiment of the invention in which a piecewise linear function is used to address data out of the transform memory 102. The word counter 19 is implemented to count modulo 64 which will correspond to a master data set having 64 data points corresponding to a maximum of 32 harmonics. The up/down counter 110 is implemented to count from 15 to 0, repeat 0 and count up to 15 etc. The 2's complement 120 will form the 2's complement binary operation on the output states from the up/down counter 110 for the states 33 to 64 of the word counter 110.

The tones resulting from the use of addressing data obtained from the up/down counter will differ from those tones obtained by using the sinusoid function to address the same data set stored in the transform memory 102. Therefore, use of switch S3 will enable the generation of two different tone types from the same set of nonlinear transform data depending upon the selected form of the addressing data.

Because of the subsystem previously described for removing the average value of the calculated master data set, there is no inherent limitation or restriction that the input addressing data to the loudness scalers be a function which is periodic with a period corresponding to the modulo counting number of the word counter 19. This lack of restriction is possible since the periodicity of the final audible musical note is assured because of the system action of transferring a master data set to a note register where it is then read out sequentially and repetitively at a periodic rate to create waveshapes at the preselected musical pitch.

Figure 7:
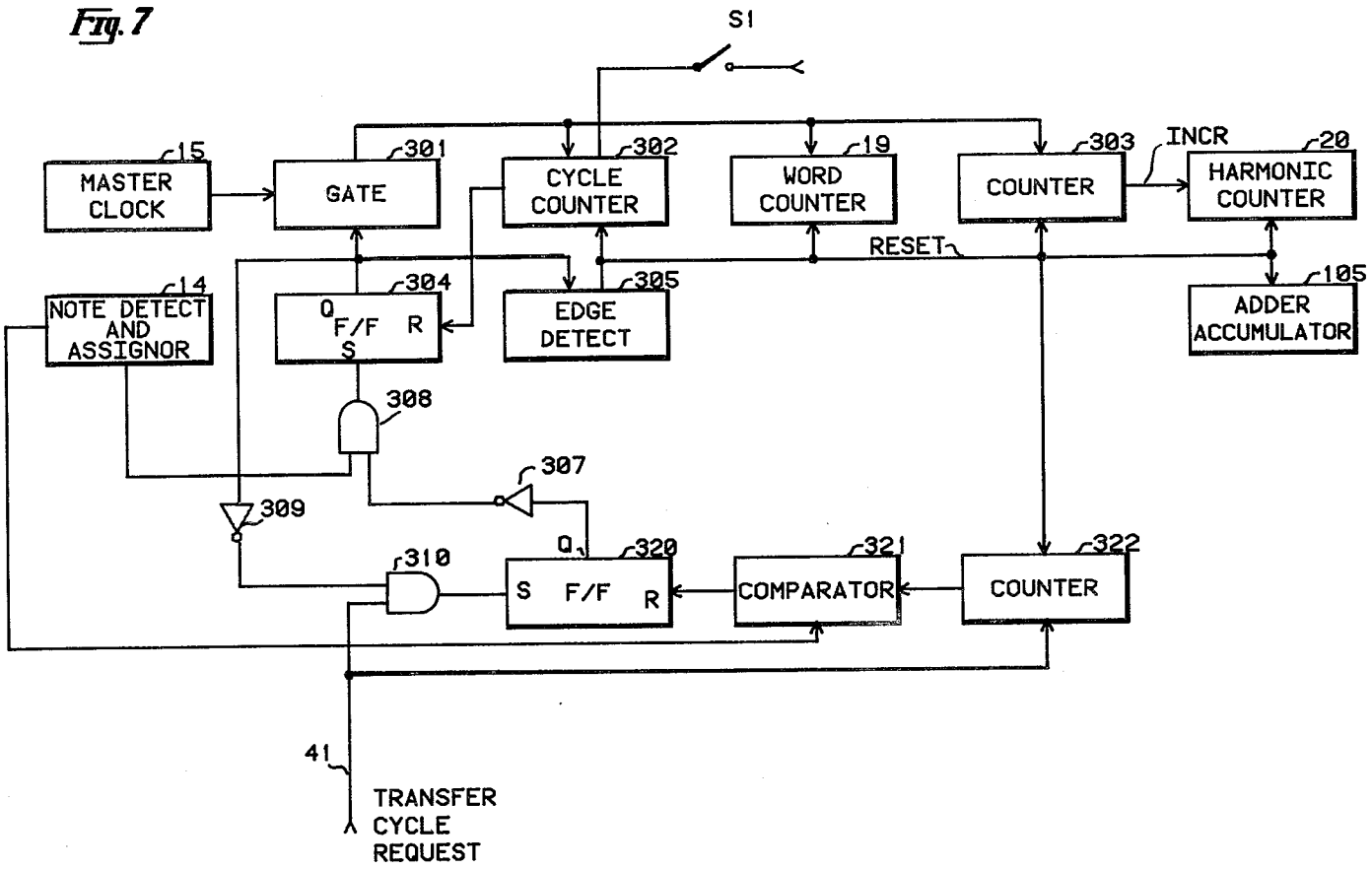
FIG. 7 is a schematic diagram showing details of the executive control.

FIG. 7 shows details of the executive control 16. The system elements in FIG. 7 having labels in the 300-number series are elements of the executive control 16. A computation cycle is initiated when flip-flop 304 is set so that its output state is Q="1." Flip-flop 304 can be set at a request from the note detect and assignor 14 if flip-flop 320 has its output state at Q="0." As described below, flip-flop 320 is used to control a transfer cycle and it is desirable that a computation cycle not be initiated while a transfer cycle is in progress. Note detect and assignor 14 will generate a request for the start of a computation cycle if this subsystem has detected that a keyswitch has been actuated on the musical instrument's keyboard. An alternative system operation logic is to always initiate a complete computation cycle when a transfer cycle is not in process, or to initiate a computation cycle at the completion of each transfer of data to a note register.

When flip-flop 304 is set at the start of a computation cycle, the output state Q="1" is converted into a signal pulse, labeled RESET, by means of the edge detect circuit 305. The RESET signal is used to initialize the counters 302,19,303, and 322. It is also used to initialize the adder accumulator 105.

The state Q="1" causes gate 301 to transfer clock timing pulses from the master clock 15 to increment counters 302, 19, 303, and 322.

Counter 303 is implemented to count modulo 32. Each time the contents of this counter is reset because of its modulo counting action, an INCR signal is generated which is used to increment the count state of the harmonic counter 20.

The counter 302 counts the master clock pulses modulo $PxH=64\times32=2048$ if switch S1 has been set for the first operation mode. This counter will count $64\times1=64$ if the switch S1 is set for the second operation mode. P=64 is the number of data words in the master data set while the second number H is the number to which the harmonic counter 20 is incremented in each of the two operation modes. When counter 302 reaches its selected maximum count a signal is generated which is used to reset the flip-flop 304.

A transfer cycle request on line 41 will set flip-flop 320 if a computation cycle is not in progress as indicated by a state Q="0" from the flip-flop 304.

The number of assigned tone generators is transferred from the note detect and assignor 14 to the comparator 321. Counter 322 is incremented by the transfer cycle requests on line 41. When the count state of counter 322 is incremented to the number of assigned tone generators contained in comparator 321, a signal is created which resets the loudness scaler 101. The state Q="0"

of flip-flop 320 permits the start of a new computation cycle.

The loudness scaler 101 can be implemented as an addressable memory storing a set of numbers, or scale factors. These numbers can be addressed out in response to the loudness control signal and used as multipliers to scale, or multiply, the input values from the sinsusoid table 24.

I claim:

1. In a musical instrument having one or more tone generators in which a plurality of data words corresponding to the amplitudes of a corresponding number of evenly spaced reference points defining the waveform of one cycle of an audio signal are computed and in which the data words are transferred sequentially from a note register to a digital-to-analog converter at a rate proportional to the pitch of the tone being generated apparatus for generating tones having a variable spectral content comprising;

a first memory means for storing a master data set comprising said plurality of data points to be thereafter read out, a second memory means for storing a set of transform data values, a signal generating means for generating a control signal, a first addressing means responsive to said control signal whereby said transform data values are accessed from said second memory means and written into said first memory means during each computation cycle of a sequence of computation cycles, a third memory means for storing data to be thereafter read out, a transfer data means wherein said master data set data values stored in said first memory means are translated in magnitude to produce a zero average value and are transferred to be stored in said third memory means, a reading means for sequentially and repetitively reading out data stored in said third memory means, and means for producing musical signal waveshapes from data words read out by said reading means.

2. In a musical instrument according to claim 1 wherein said first addressing means comprises;

a word counter incremented at each computation time in said computation cycle wherein said word counter counts modulo the number M of data values comprising said master data set, a sinusoid table storing values of cos ($2\pi N/M$) where N is an address index number, a second addressing means responsive to contents of said word counter for addressing data values from said sinusoid table, scaling circuitry for multiplying data values addressed from said sinusoid table by scale factors selected by said control signal, and addressing circuitry whereby said transform data values are accessed from said second memory means in response to output data values from said scaling circuitry thereby generating tones having a spectral content varied by said control signal.

3. In a musical instrument according to claim 1 wherein said first addressing means comprises:

a word counter incremented at each computation time in said computation cycle wherein said word counter counts modulo the number M of data values in said master data set, an up/down counter incremented by changes in state of said word counter, scaling means for multiplying contents of said up/down counter by scale factors selected by said control signal, and addressing circuitry whereby said transform data values are accessed from said second memory means in response to output data values from said scaling means thereby generating tones having a spectral content varied by said control signal.

4. In a musical instrument according to claim 1 wherein said transfer data means comprises;

2's complement circuitry for forming the binary 2's complement of data values in said master data set, division circuitry wherein said 2's complement form of master data set are divided by a value M equal to the number of data values in said master data set, an adder-accumulator means initialized at the start of said computation cycle for successively adding and storing the output from said division circuitry, and adder means for adding said stored output from said adder-accumulator means with data values in said master data set thereby translating said master data set values to produce a translated master data set having zero average value.

5. In a musical instrument according to claim 1 wherein said set of transform data values comprise values $F_j$ computed in accordance with the relation $$F_j = \sum_{n=0}^{N} P_n c_n \cos(\pi nj/k),$$

where j is an index denoting the address of a value in said second memory means, 2k is the number of elements in said set of transform data values, $c_n$ is an element of a set of N harmonic coefficients, and $P_n$ is an element of a set of phase constants each having the value +1 or −1.

6. A musical instrument according to claim 2 wherein said scaling circuitry further comprises;

a scale factor memory for storing a set of data values comprising said scale factors, and scale factor memory addressing means for accessing scale factors from said scale factor memory in response to said control signal.

7. In a musical instrument having one or more tone generators in which a plurality of data words corresponding to the amplitudes of a corresponding number of evenly spaced reference points defining the waveform of one cycle of an audio signal are computed and in which the data words are transferred sequentially and repetitively from a note register to a digital-to-analog converter at a rate proportional to the pitch of the tone being generated apparatus for generating additive tones each having a variable spectral content comprising;

a first memory means for storing a master data set comprising said plurality of data points to be thereafter read out, a signal generator means for generating a control signal, a plurality of transform memory means for storing a plurality of sets of transform data values, an addressing means responsive to said control signal for addressing transform data values from said plurality of transform memory means, summation means for adding said addressed transform data values thereby generating elements of said master data set, a second addressing means for writing output from said summation means into said first memory means during each computation cycle of a sequence of computation cycles, a third memory means for storing data to be thereafter read out, a transfer data means wherein said master data set values stored in said first memory means are translated in magnitude to produce a zero average value and transferred to be stored in said third memory means, a reading means for sequentially and repetitively reading out data stored in said third memory means, and means for producing musical signal waveshapes from data read out by said reading means.

8. A musical instrument according to claim 7 wherein said plurality of transform memory means comprises;

a plurality of memories each storing a set of transform data values, and a plurality of switches selectively actuable to provide addressing signals from said addressing means to selected memories in said plurality of memories.

9. A musical instrument according to claim 7 wherein said addressing means comprises;

a word counter incremented at each computation time in said computation cycle wherein said word counter counts modulo the number M of data values comprising said master data set, a sinusoid table storing values of cos $(2\pi N/M)$ where N is an address index number, a table addressing means responsive to contents of said word counter for addressing data values from said sinusoid table, a plurality of scaling means for multiplying data values addressed from said sinusoid table by scale factors selected by said control signal, a plurality of switches selectively actuable to provide said data accessed from said sinusoid table to corresponding members of said plurality of scaling means, and a plurality of addressing circuitry each associated with a corresponding element of said plurality of scaling means for addressing transform data values from said plurality of transform memory means.

10. A musical instrument according to claim 9 wherein said plurality of scaling means further comprises;

a plurality of scale factor memories each storing a set of data values comprising said scale factors, and a plurality of scale factor memory means each associated with a corresponding element of said plurality of scale factor memories for accessing data values in response to a plurality of control signals.

11. A digital polyphonic tone synthesizer in which tones of variable spectral content are generated in response to control signals comprising;

a keyboard comprising a plurality of key switches, a plurality of tone switches wherein each setting of the tone switches corresponds to the selection of a predetermined tone of variable spectral content, a plurality of transform memories each containing a set of transform data values.

a signal generating means for generating control signals, a plurality of addressing means responsive to said control signals for addressing transform data values from said plurality of transform memories, summation means for adding said addressed transform data values, a main register for storing added values from said summation means to be thereafter read out, a plurality of registers, transfer means whereby data stored in said main register is read out, translated in magnitude to have a zero average value, and transferred to selected members of said plurality of registers, a plurality of variable frequency clock generators each associated with a member of said plurality of registers whereby data is addressed out of associated registers at a selected clock rate, means responsive to operation of any member of said plurality of key switches for setting the frequencies of said clock generators to predetermined values assigned to key switches, digital-to-analog converter means connected to said plurality of registers, and means for repetitively and sequentially reading data from each of said plurality of registers and providing the data to said digital-to-analog converter means in synchronism with said associated clock generator, whereby the digital-to-analog converter means generates a plurality of analog output signals each having a fundamental frequency determined by a selected key on said keyboard and a waveshape determined by the combination of the setting of said tone switches and the magnitude of said control signals.

* * * * *